US005096069A

United States Patent [19]

Brandon

[11] Patent Number: 5,096,069

[45] Date of Patent: Mar. 17, 1992

[54] ACCESSORY FOR HANGING WALL CALENDAR

[76] Inventor: Daniel E. Brandon, 144 E. Polk St., Waterloo, Wis. 53594

[21] Appl. No.: 661,529

[22] Filed: Feb. 26, 1991

[51] Int. Cl.[5] ..... A47F 7/00

[52] U.S. Cl. ..... 211/45; 211/71

[58] Field of Search ..... 211/45, 89, 175, 94, 211/71; 248/488, 448; 40/617, 120

[56] References Cited

U.S. PATENT DOCUMENTS

| | | | |
|---|---|---|---|
| 140,300 | 6/1873 | Ogden . | |
| 286,736 | 10/1883 | Shepard . | |
| 413,371 | 10/1889 | O'Brien . | |
| 1,061,133 | 5/1913 | Shedd . | |
| 1,316,039 | 8/1919 | James . | |
| 1,371,269 | 3/1921 | Stevens . | |
| 1,602,341 | 10/1926 | Day | 211/45 X |
| 1,622,223 | 5/1926 | Desbarats . | |
| 1,907,261 | 6/1932 | Shedd . | |
| 2,041,097 | 8/1935 | Vierling . | |
| 2,160,104 | 3/1937 | Kulow . | |
| 2,526,575 | 6/1948 | Neal . | |
| 2,580,885 | 1/1952 | Brodkey | 211/89 |
| 2,622,300 | 12/1952 | Marziani | 211/45 X |
| 2,867,918 | 1/1959 | Miller | 40/617 X |
| 3,370,367 | 3/1966 | Stratton et al. | 40/119 |
| 3,515,284 | 6/1970 | Taylor | 211/89 X |
| 3,529,371 | 12/1970 | Moore | 40/120 |
| 4,209,098 | 6/1980 | Adams | 211/94 X |
| 4,698,930 | 10/1987 | McNair | 40/617 X |
| 4,840,341 | 6/1989 | Hasegawa | 211/89 X |
| 4,953,714 | 9/1990 | Paul | 211/89 X |

FOREIGN PATENT DOCUMENTS

| | | | |
|---|---|---|---|
| 0659883 | 2/1965 | Belgium | 211/45 |
| 0185792 | 6/1956 | Fed. Rep. of Germany | 211/45 |
| 0273878 | 7/1927 | United Kingdom | 211/89 |
| 1454535 | 11/1976 | United Kingdom | 211/89 |

*Primary Examiner*—Reinaldo P. Machado
*Assistant Examiner*—Sarah A. Lechok
*Attorney, Agent, or Firm*—Lathrop & Clark

[57] ABSTRACT

A calendar accessory for use with a wall calendar of the type having sheets bound in the middle to form pages is constructed of a linear, vertically extending plastic member wherein the length of the member is substantially greater than its width and the width is substantially greater than its thickness. The member has a centrally located clearance hole extending through the member. The hole is adapted for receiving a nail which partially penetrates a vertical surface or wall. The linear member has a depending tab at either end. The calendar holder is used by placing the central hole over a nail embedded in a wall or other vertical surface, after which the calendar is hung by placing it over the supporting nail. The linear member lies behind and along the horizontal upper edge of the suspended calendar.

The tabs depend from the upper edge near the ends of the horizontal member and extend outwardly and downwardly to retain the calendar pages. The tabs overlie and retain the top portion of the upper corners of the calendar page preventing them from drooping.

The calendar accessory may have tabs which are mounted on sliders which are retained on a rail on the linear member by friction wherein the tabs may slide in and out to accommodate calendars of varying widths.

20 Claims, 3 Drawing Sheets

FIG. 2
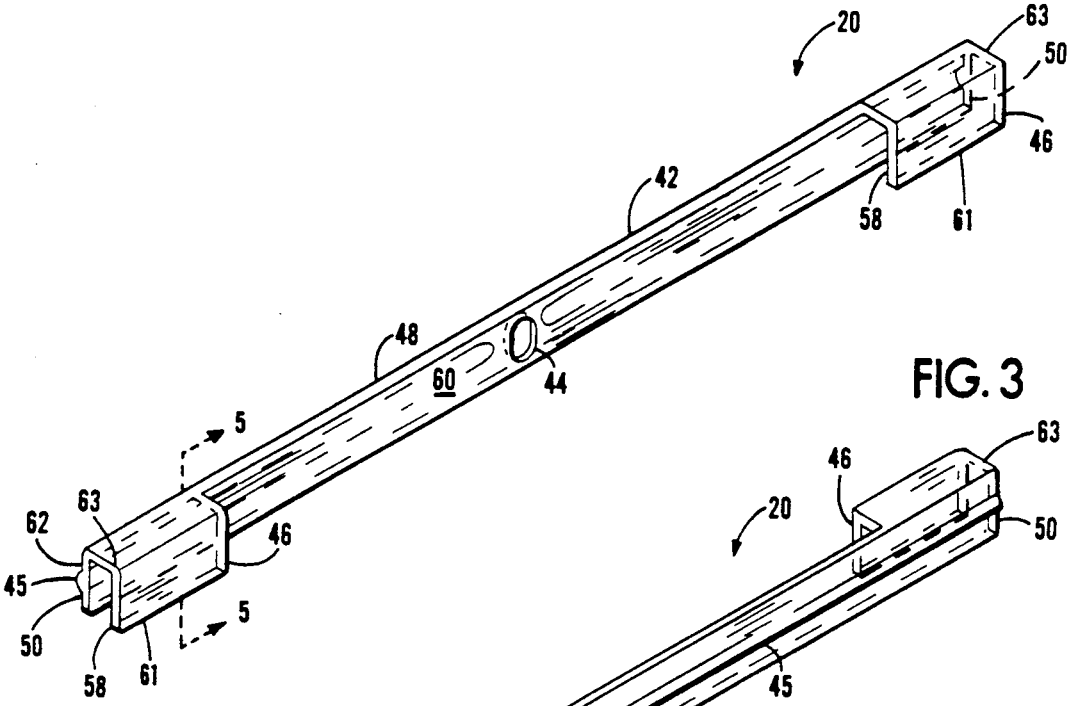
FIG. 3
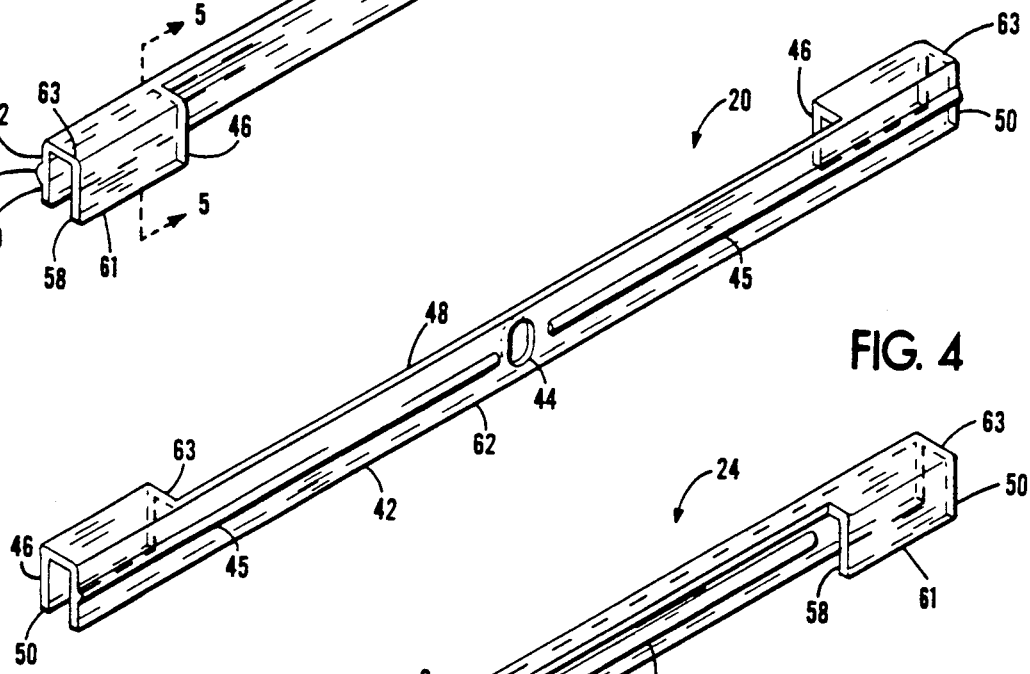
FIG. 4
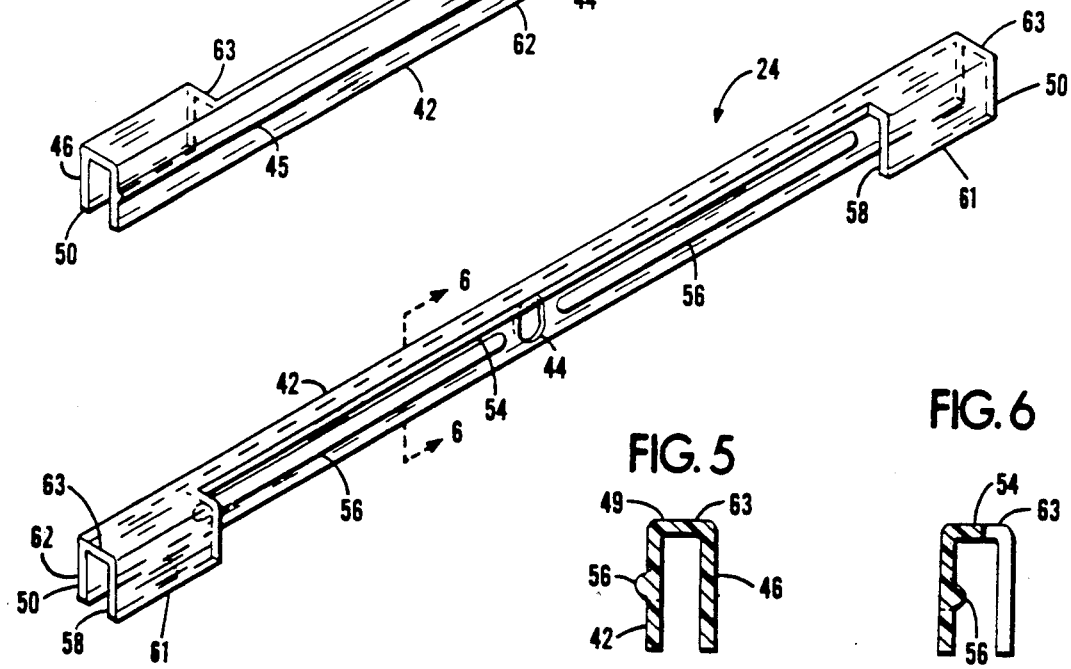
FIG. 5
FIG. 6

ACCESSORY FOR HANGING WALL CALENDAR

FIELD OF THE INVENTION

This invention relates to accessories for hanging wall calendars in general.

BACKGROUND OF THE INVENTION

Calendars which are intended to be hung on the wall often include attractive illustrations and functional tabular monthly listings of the days of the year. The illustrations and tabular monthly listings are often printed on opposing pages. The pages are often bound and joined into a pamphlet. Calendars of this type will normally consist of a soft cover and will contain six or seven sheets which are folded and stapled to the cover along a central fold.

This type of calendar is normally hung from a nail or hook on the wall. The nail or hook is passed through a hole in the center of the outer edge of the front cover of the calendar. The pages are likewise punched with a hole corresponding to the hole in the front cover. The calendar is hung so the fold line or binding is parallel to the ground.

The calendars usually have illustrations on the top of the pages closest to the nail or hook with the days of the month in tabular form on the pages opposite and below the illustrations. Each month a new page is brought into view by lifting up the page containing the last month's tabulation of days and placing the perforated hole in the lower edge of that page over the nail thus displaying the illustration on the back of the previous month's calendar page and displaying a new monthly calendar page beneath the new illustration.

A common problem associated with calendars of this type is that the corners of the illustrated pages tend to droop. The inward drooping of the edges of the pages obscures the illustration and otherwise creates an unpleasant visual effect.

Some types of calendars are supplied with sturdy cardboard covers which have punched out tabs which may overlie the upper margins of the pages containing the monthly illustrations and so keep them from drooping.

Other calendars come equipped with metal clips or cardboard flaps designed to retain the upper edge of the illustrated pages.

Often pleasantly illustrated wall calendars are distributed free as a form of advertisement. However, for reasons of cost or packaging convenience, rarely will the calendar incorporate features for supporting the page edges. Even when a calendar is purchased, it rarely incorporates the metal clips or paper tabs necessary to retain the upper edges of the illustration to keep the illustration flat and attractively displayed.

What is needed is a low cost accessory which may be used with a wall calendar to retain the edges of the illustrated pages so that the calendar retains its attractive appearance.

SUMMARY OF THE INVENTION

The calendar accessory of this invention is constructed of plastic. It has a linear, vertically extending member the length of which is substantially greater than its width and the width is substantially greater than its thickness. The member has a centrally located hole forming a penetration through the thickness of the member. The hole is adapted for receiving a nail which partly penetrates a vertical surface or a wall. The linear member has a tab at either end. The calendar holder is used by placing the central hole over a nail embedded in a wall or other vertical surface, after which a calendar with multiple pages is hung by placing it over the supporting nail. The linear member then lies behind and along the upper horizontal edge of the suspended calendar. The tabs depend from the upper edge near the ends of the horizontal member and extend outwardly and downwardly to retain the calendar pages. The tabs overlie and retain the top portion of the upper corners of the calendar pages.

It is an object of the present invention to provide a plastic accessory for use with wall calendars for retaining the upper edges of the pages of such calendars.

It is another object of the present invention to provide a plastic accessory for use with wall calendars which does not obscure the edges of the calendar pages.

It is a further object of the present invention to provide an accessory for use with calendars of varying sizes.

Further objects, features, and advantages of the nvention will be apparent from the following detailed description when taken in conjunction with the accompanying drawings.

BRIEF DESCRIPTION OF THE DRAWINGS

FIG. 2 is a front isometric view of the calendar accessory of FIG. 1.

FIG. 3 is a rear isometric view of the calendar accessory of FIG. 1.

FIG. 4 is an isometric view of another embodiment of the calendar accessory of this invention.

FIG. 5 is a cross-sectional view taken along section line 5—5 of FIG. 2.

FIG. 6 is a cross-sectional view taken along section line 6—6 of FIG. 3.

DESCRIPTION OF THE PREFERRED EMBODIMENT

Figure 1:
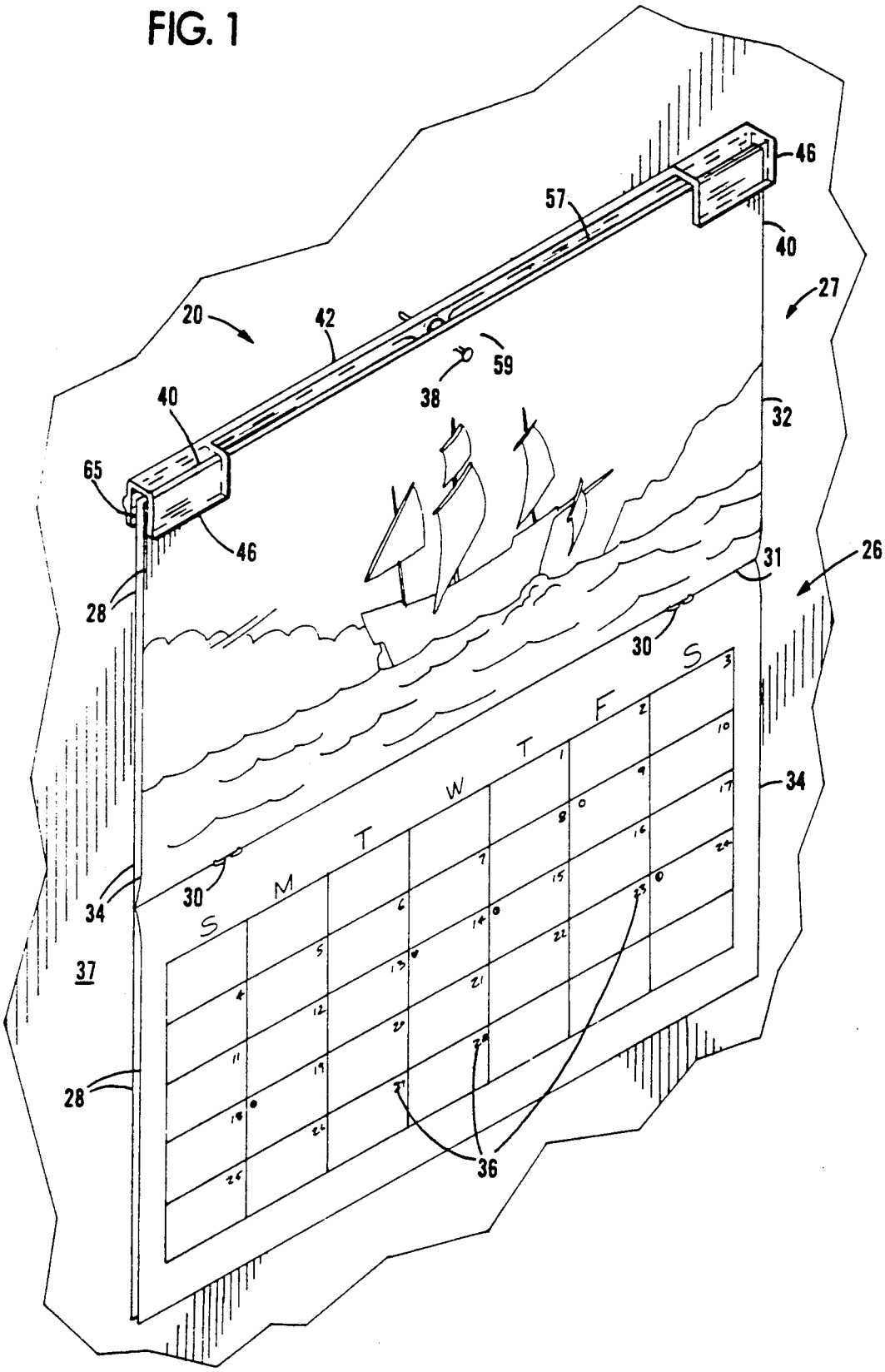
FIG. 1 is a front isometric view of the calendar accessory of this invention with a calendar mounted therein.

Referring more particularly to FIGS. 1—9 wherein like numbers refer to similar parts, a calendar accessory 20 is shown in FIGS. 1, 2 and 3. The calendar accessory 20 is used in conjunction with a calendar 26 which has sheets 27, which are folded along their centers to form pages 28. The folded sheets 27 are joined in the middle by staples 30. A fold line 31 divides the pages 24 into upper illustrated pages 32 and lower calendar pages 34 containing tabular listings 36 of the days of the month. The calendar 26 is hung on a wall by a nail 38. Over time, the upper corners 40 of the illustrated pages 32 will tend to curl or droop forward in the absence of any restraining device.

The calendar accessory 20 employs a linear member 42 which has a central clearance hole 44 which fits over the nail 38. Depending tabs 46 extend from the upper edge 48 of the linear member 42 and are adjacent to the ends 50 of the linear member 42. The tabs 46 serve to retain the upper corners 40 of the illustrated pages 32 flat against the linear member 42 and prevent drooping of the corners 40.

As shown in FIG. 5, the depending tabs 46 have outwardly extending portions 63 which extend from the upper edge 48 of the linear member 42 and downwardly extending portions 61 which depend from the outwardly extending portions 63.

The calendar accessory 20 has a stiffening protrusion 45 on the rear face 62 which increases the rigidity of the linear member 42.

An alternative embodiment calendar accessory 24, shown in FIG. 4, has a lateral stiffening flange 54 which extends outwardly from the upper edge 48 of the linear member 42 and is partly coextensive with the outwardly extending portions 63 of the tabs 46. The stiffening flange 54 and stiffening protrusions 56 serve to increase the rigidity of the linear member 42. The greater stiffness imparted by the stiffening flange 54 and the stiffening protrusion 56 helps to keep the linear member 42 flat against a wall under the load imposed by the illustrated pages 32 as they push against the inner edges 58 of the tabs 46.

The calendar accessorys 20 and 24 are for economy of production formed of plastic. The plastic will preferably be transparent, but any plastic with moderate structural strength and stiffness may be used to form the calendar accessory. The use of transparent plastic prevents the obscuring of any part of the calendar pages. The tabs 46 do not grip or pinch the upper corners 40 of the calendar, so the plastic of which the calendar accessory 20 is constructed does not require significant resiliency.

The calendar accessory 20 is used with the calendar 26 by aligning the clearance hole 44 behind and adjacent to the mounting hole 59 in the pages 28 of the calendar 26. The clearance hole 44 of the accessory is preferably oblong about a vertical axis to accommodate variations in the placement of the calendar mounting hole 59 from the upper edges 57 of the calendar pages 32. The front surface 60 of the calendar accessory 20 is held adjacent to the backside 65 of the upper edge 57 of the calendar 26, and the calendar 26 and the calendar accessory 20 are slid over the nail 38. The nail 38 will normally partially penetrate the wall 37 so that a portion of the shank is exposed, so holding the nail head spaced from the wall surface. The calendar accessory 20 is supported by the nail shank or it may be supported by the upper edges of the calendar page on the outwardly extending part 63 of the tabs 46. The outer corners 40 of the illustrated pages 32 are then tucked under depending tabs 46 if they are not already overlain by the tabs. At the beginning of each month the lower calendar page is turned up and placed over the nail 38 and the corners 40 of the illustrated pages 32 are tucked under the tabs 46.

Although the stiffening protrusions 56 are shown on the preferred embodiments, it should be understood that stiffening protrusions may be omitted, or two or more stiffening protrusions may be provided depending on the stiffness of the material used and the dimensions of the accessory.

Figure 7:
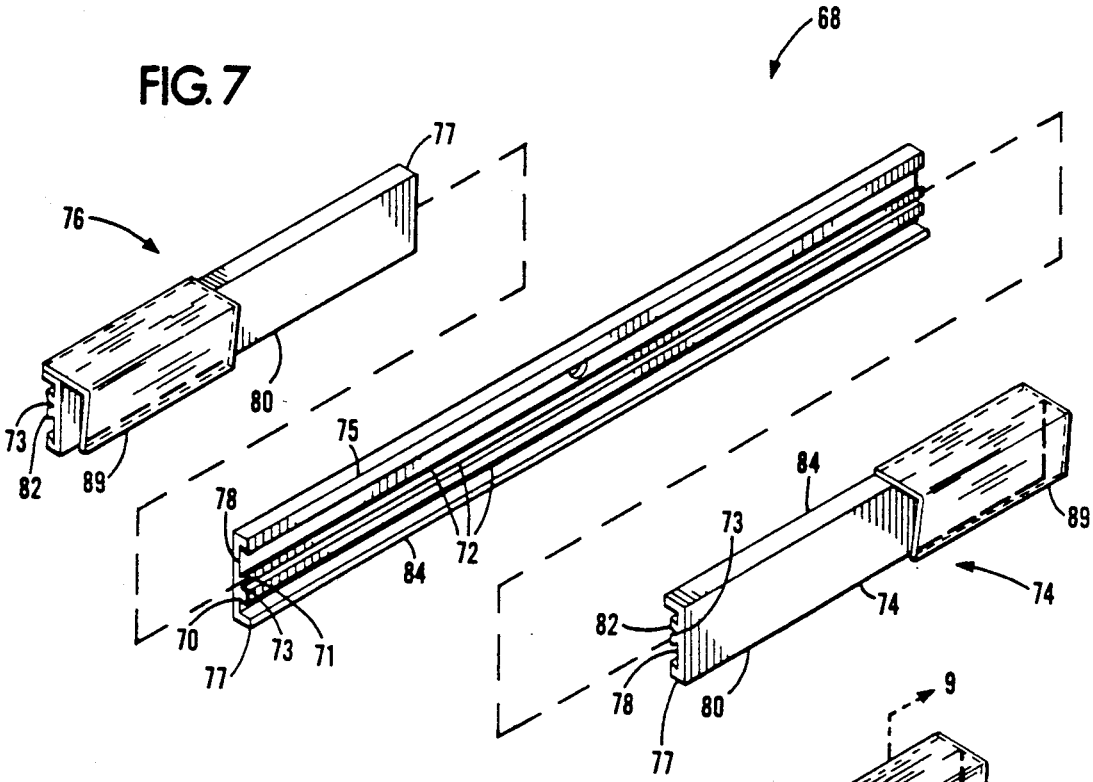
FIG. 7 is an exploded isometric view of a calendar accessory with slidable depending tabs.
Figure 8:
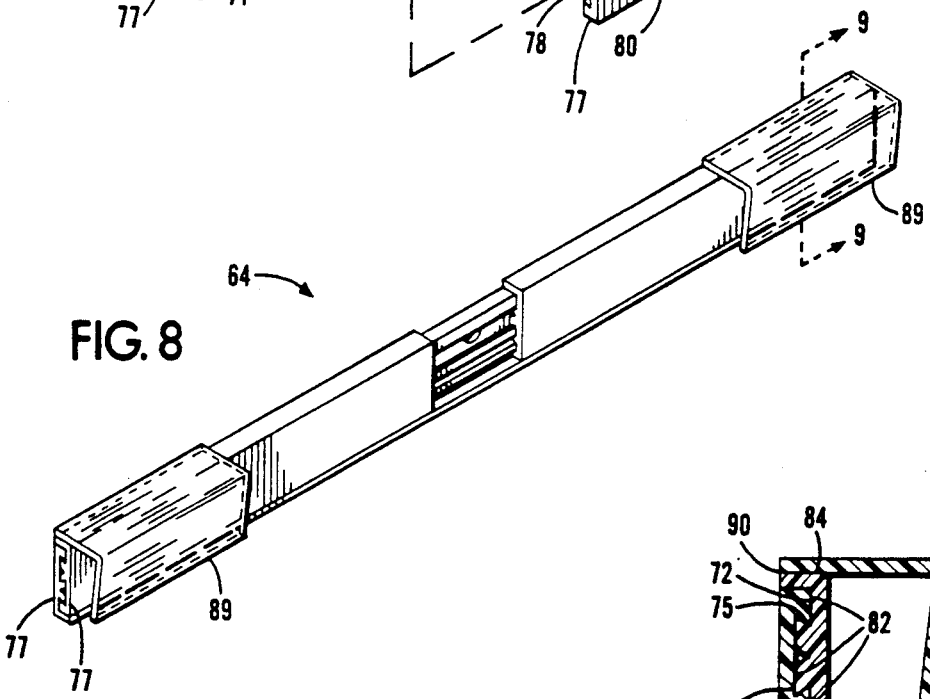
FIG. 8 is a front isometric view of the assembled calendar accessory of FIG. 7.
Figure 9:
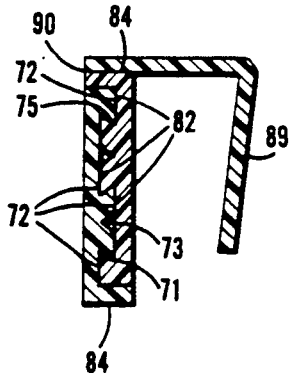
FIG. 9 is a cross-sectional view taken along section line 9—9 of FIG. 8.

A calendar accessory 64, which has depending tabs 66 which are adjustable for use with calendars of varying width is shown in FIGS. 7, 8, and 9. The calendar accessory 64 has a linear member 68 upon which is slidably mounted a right-hand slider 74 and a left-hand slider 76, the sliders having depending tabs 66 for holding the upper corners 40 of a calendar. The positions of the tabs 66 may be adjusted by sliding the sliders 74, 76 along the linear member 68, to accommodate a calendar of any width.

Both the sliders 74, 76 and the linear member 68 are preferably manufactured from a common extrusion 77. The extrusion 77, best shown in FIGS. 7 and 9, has a constant cross section. The extrusion 77 which forms the linear member 68 has a front face 79 with a protruding flange 84. Spaced above the flange 84 and protruding in the same direction as the flange, is a dovetail rail 70. The dovetail rail 70 has a "V" shaped groove 73 centered in the middle of the rail 70 and defining two somewhat flexible rail flanges 71. The top of the extrusion 77 has a lip 75 which, together with the adjacent rail flange 71, defines a dovetail groove.

The slider bodys 80 are formed from a shorter section of extrusion 77 which is inverted such that the flange 84 is uppermost when the slider body 80 is brought adjacent to the linear member 68 so that the dovetail groove 78 and the slider body 80 is opposed to the dovetail rail 70 on the linear member 68. This also brings the dovetail rail 70 of the linear member 68 opposed to the dovetail groove 78 of the slider body. The flange 84 of the slider body will overlie the lip 75 of the linear member 68 and the flange 84 of the linear member 68 will overlie the lip 75 of the slider body 80. The sliders 74, 76 are assembled on the linear member 68 to form a calendar accessory 64 which has adjustable depending tabs 66 for holding the upper corners 40 of the pages of a calendar. A depending tab 66 is fixedly attached to the slider body 80 of each slider 74, 76 along a bonding surface 90 which is the outer surface of the flange 84 of the extrusion 77 which forms the slider body 80. The depending tabs 66 are attached along surface 90 by a suitable glue or by welding. The tabs are preferably made from a transparent plastic so the tabs do not obscure the upper corners 40 of the illustrated calendar pages. The fit between the linear member 68 and the slider body 80 will preferably form a sufficiently tight interference fit such that the sliders are movable on the linear member, but will remain in whatever position they are adjusted to.

Frictional forces involved in the function of the adjustable calendar accessory 64 are dependent on two factors: 1) the coefficient of friction between the surfaces; and, 2) the forces normal to the sliding surfaces 72, 82. A plastic with a moderate to high coefficient of friction is desireable. It is also desireable to form the linear member or the body of the sliders of at least slightly resilient material. If the linear member and the slider body are manufactured with an interference fit so that one or the other is deformed slightly upon assembly, the resilient deformation of the linear member or the slider body will produce a clamping force between the grooves and the rails, which will result in normal forces on the sliding surfaces 72, 82. Normal forces, together with the coefficient of friction of the sliding surfaces 72, 82, will produce the frictional forces which will keep the sliders 74, 76 in the positions to which they have been adjusted. Normal forces between the sliding surfaces 72, 82 of the extrusion 77 which make up the linear member 68 and slider body 80 are caused by the deflection of the rail flanges 71 and the flange 84 and lip 75. Resilient deflection of the protruding components on the extrusion 77 causes normal forces on the sliding surfaces 82 which, together with the coefficient of friction between the sliding surfaces 82, produce a frictional force between the linear member 68 and the slider 74, 76.

Although the calendar accessory 64 with adjustable depending tabs 66 may be made of individual injection molded parts, it will preferably be fabricated of plastic extrusions. As shown in FIG. 7, the depending tabs preferably do not extend the full length of the sliders 74, 76.

Although the adjustable calendar accessory 64 is shown with opposing dovetail rails riding in dovetail grooves, it is understood that one or more rail and groove assemblies could be employed and that they could have shapes other than dovetail, and that such rails could secure the sliders to the linear member alone or in cooperation with each other. It should also be understood that where the rails are shown on the front of the linear member, they could also be on the back, top or bottom.

The calendar accessory is illustrated in use with a calendar 26 which is bound with staples 30, but may be used with similar calendars which have spiral bindings or the like.

The calendar accessory may have an oblong shaped mounting hole, or a circular, keyhole shape, triangular or rectangular hole could be used.

The calendar accessory of this invention will be preferably injection molded or extruded, but could be formed by any cost-effective plastic forming method.

The calendar accessory of this invention could be used to display indicia on tabs 46, 89. Indicia displayed on tabs 46, 89 may be a trade name and a phone number or the like making the calendar accessory 20, 24, 64 suitable for use as a specialty item which is given to customers by a trade or business as a form of advertising.

It is understood that the invention is not confined to the particular construction and arrangement of parts herein illustrated and described, but embraces such modified forms thereof as come within the scope of the following claims.

I claim:

1. A plastic accessory for retaining the pages of a vertically hung calendar having a plurality of joined pages; comprising:

a) a linear member extending horizontally and having to ends, and upper edge, and front and back surfaces;

b) two tabs extending from the linear member, each tab having a portion which extends outwardly from the upper edge of the linear member and a portion which extends downwardly from the outwardly extending portion, the downwardly extending portions being spaced parallel to the front surface of the linear member, so defining a gap between each tab and the front surface of the linear member wherein the gaps are adapted to receive the upper corners of a calendar located within the accessory and to retain the corners in a substantially upright position.

2. The calendar accessory of claim 1 wherein the tabs are formed of transparent plastic.

3. The calendar accessory of claim 1 further comprising a stiffening flange extending outwardly from the upper edge of the linear member.

4. The calendar accessory of claim 1 wherein the linear member has at least one linear protrusion which extends outwardly from the front surface of the linear member.

5. The calendar accessory of claim 1 wherein the linear member has a least one rail extending along the length of the linear member; and wherein each depending tab is mounted on a slider body, and the slider body has groove which slideably engages the rail on the linear member, each tab being slide able along the linear member to accommodate calendar pages of different widths.

6. A plastic accessory for use with a nail or the like and a calendar which has pages, where the calendar is hung from the nail or the like on a vertical surface, comprising: a linear member having a length, a width, a thickness and an upper edge, the width having a front side and a back side and the length having two ends, wherein the width is substantially less than the length and lies in parallel relation to the vertical surface with a back face adjacent to the front surface and a front face opposed to the back face, wherein the thickness is substantially less than the width of the member, and wherein the member has a portion defining a clearance hole extending through the width and penetrating the back surface and the front surface, the hole being substantially equidistant from the ends of the member, and the hole is adapted to receive a nail partially penetrating the vertical surface wherein the nail supports the linear member with its back face adjacent to the wall and its front face adjacent to a calendar, which is also supported by the nail; the linear member further having tabs which extend from the upper edge of the member adjacent to the member ends, the tabs extending outwardly and downwardly and lying in parallel spaced relation to the front face of the linear member, so defining a gap between each tab and the linear member, the gaps being adapted for receiving the pages of a calendar.

7. The calendar accessory of claim 6 wherein the tabs are constructed from transparent plastic.

8. The calendar accessory of claim 6 wherein the linear member has a stiffening flange extending outwardly from the upper edge of the linear member.

9. The calendar accessory of claim 6 wherein the linear member has at least one linear protrusion which extends outwardly from the front surface of the linear member.

10. The calendar accessory of claim 6 wherein the linear member has at least one linear protrusion which extends outwardly from the rear surface of the linear member.

11. The calendar accessory of claim 6 wherein the linear member has a least one rail extending along the length of the linear member; and, wherein the depending tabs are further comprised of a slider body, the slider body having a groove, the groove being slide able over the rail of the linear member, the slider body forming a movable upper edge of the linear member, from which the tabs extend depending outwardly and downwardly over the slider body and linear member so forming the tabs which support the pages of the calendar.

12. A plastic accessory for use with a protrusion extending from a vertical surface and a calendar which has pages, wherein the calendar is hung on the vertical surface, comprising:

(a) a linear member, having a length, a width, and a thickness, the member having two ends:

(b) a right slider having a body, the body having a right side, an upper edge, and is slideably mounted on the linear member, the right slider having a tab which extends from the upper edge of the slider body near the right end of the slider body, the tab extending outwardly and downwardly over the body of the slider defining a gap between the tab and the slider body, the gap being adapted to receive and support the pages of a calendar; and (c) a left slider having a body, the body having a length, a left side, an upper edge, and is slideably mounted on the linear member, the left slider having a tab which extends from the upper edge of the slider body near the left end of the slider body, the tab extending outwardly and downwardly over the body of the slider defining a gap between the tab and the slider body, the gap being adapted to receive and support the pages of a calendar.

13. The calendar accessory of claim 12 wherein the right slider and the left slider have portions defining a groove, and wherein the linear member has a portion defining a rail, where the rail and the slider grooves are engaged to slideably mount the sliders on the linear member.

14. The calendar accessory of claim 12 wherein the rail has the shape of a dovetail and wherein the groove has the shape of a dovetail.

15. The calendar accessory of claim 12 wherein the linear member has a back surface and a front surface and a rail extends from the front surface and wherein the slider body has a front surface and a back surface, the back surface having formed therein a groove for riding on the rail of the linear member.

16. The calendar accessory of claim 12 wherein the linear member has portions defining an oblong clearance hole approximately half-way between the ends of the member adapted to permit the passage of a wall-mounted nail therethrough.

17. The calendar accessory of claim 12 wherein the linear member has a lower edge, and a flange extends from said lower edge and wherein the bodies of the right and left sliders have a lower edge, the lower edge of the sliders being in sliding engagement with the flange so that the flange may be biased upward to increase the frictional forces between the sliders and the linear member.

18. The calendar accessory of claim 12 wherein the tabs are made of transparent material so they provide visibility of the pages of a calendar.

19. The calendar accessory of claim 12 wherein the linear member has a back surface and a front surface and wherein the front surface has a rail extending from the front surface and portions of the front surface forming a groove, and wherein the slider body has a front surface and a back surface, the back surface having a rail which extends therefrom and having portions which define a groove, the slider body and the linear member being adapted to slide one upon the other, wherein the slider body rail rides in the groove of the linear member and the rail on the linear member rides in the groove of the slider body.

20. A plastic accessory for use with a protrusion extending from a vertical surface and a calendar which has pages, wherein the calendar is hung on the vertical surface, comprising:

(a) a linear member, having a length, a width, and a thickness, the member having to ends;

(b) a right slider having a body, the body having a right side, an upper edge, and is slideably mounted on the linear member, the right slider having a tab which extends from the upper edge of the slider body near the right end of the slider body, the tab extending outwardly and downwardly over the body of the slider so supporting the pages of a calendar; and (c) a left slider having a body, the body having a length, a left side, an upper edge, and is slideably mounted on the linear member, the left slider having a tab which extends from the upper edge of the slider body near the left end of the slider body, the tab extending outwardly and downwardly over the body of the slider so supporting the pages of a calendar and, wherein the linear member and the right and left slider bodies have cross sections which are the same but in inverted relationship to each other such that when the cross sections of the slider bodies are inverted relative to the cross section of the linear member, the slider bodies may be slideably mounted on the linear member.

* * * * *